United States Patent [19]

Franz et al.

[11] 4,338,845

[45] Jul. 13, 1982

[54] SYSTEM FOR EXPANDING THE DYNAMIC VOLUME RANGE OF ELECTRONIC MUSICAL INSTRUMENTS

[75] Inventors: Reinhard Franz, Tulpenstrasse 15, D-5401 Emmelshausen; Wilfried Dittmar, Halsenbach, both of Fed. Rep. of Germany

[73] Assignee: Reinhard Franz, Halsenbach, Fed. Rep. of Germany

[21] Appl. No.: 236,241

[22] Filed: Feb. 20, 1981

[30] Foreign Application Priority Data

Feb. 21, 1980 [DE] Fed. Rep. of Germany ..... 3006400

[51] Int. Cl.[3] ..... G10H 3/00

[52] U.S. Cl. ..... 84/1.1; 84/1.24; 84/1.26

[58] Field of Search ..... 84/1.1, 1.24, 1.26, 84/1.13, DIG. 7, 1.27

[56] References Cited

U.S. PATENT DOCUMENTS

| | | | |
|---|---|---|---|
| 3,634,594 | 1/1972 | Hiyama | 84/1.1 |
| 3,652,774 | 3/1972 | Ohno | 84/DIG. 7 |
| 3,935,783 | 2/1976 | Machanian et al. | 84/1.26 |
| 4,099,439 | 7/1978 | Luce | 84/1.24 |
| 4,213,367 | 7/1980 | Moog | 84/1.1 |

*Primary Examiner*—J. V. Truhe
*Assistant Examiner*—Forester W. Isen
*Attorney, Agent, or Firm*—Kontler, Grimes & Battersby

[57] ABSTRACT

An electronic musical instrument wherein depression of a key entails the discharge of a primary capacitor which is connected to the inverting input of an operational amplifier whose output is connected with a second capacitor serving to supply envelope control voltage signals to an analog switch which connects a tone signal generator with a tone processing unit. The extent to which the primary capacitor discharges depends on the speed of movement of the key from non-depressed to depressed position, and the intensity of residual voltage of the partially discharged primary capacitor determines the intensity of the envelope control voltage signal. The speed at which the second capacitor discharges can be regulated to produce sustain or banjo effects. The second capacitor is in series with a resistor in a feedback conduit connecting the output and the input of the operational amplifier. A second feedback connection contains a diode which ensures that a reference potential is applied to the input of the operational amplifier while the primary capacitor is charged in non-depressed position of the key.

26 Claims, 1 Drawing Figure

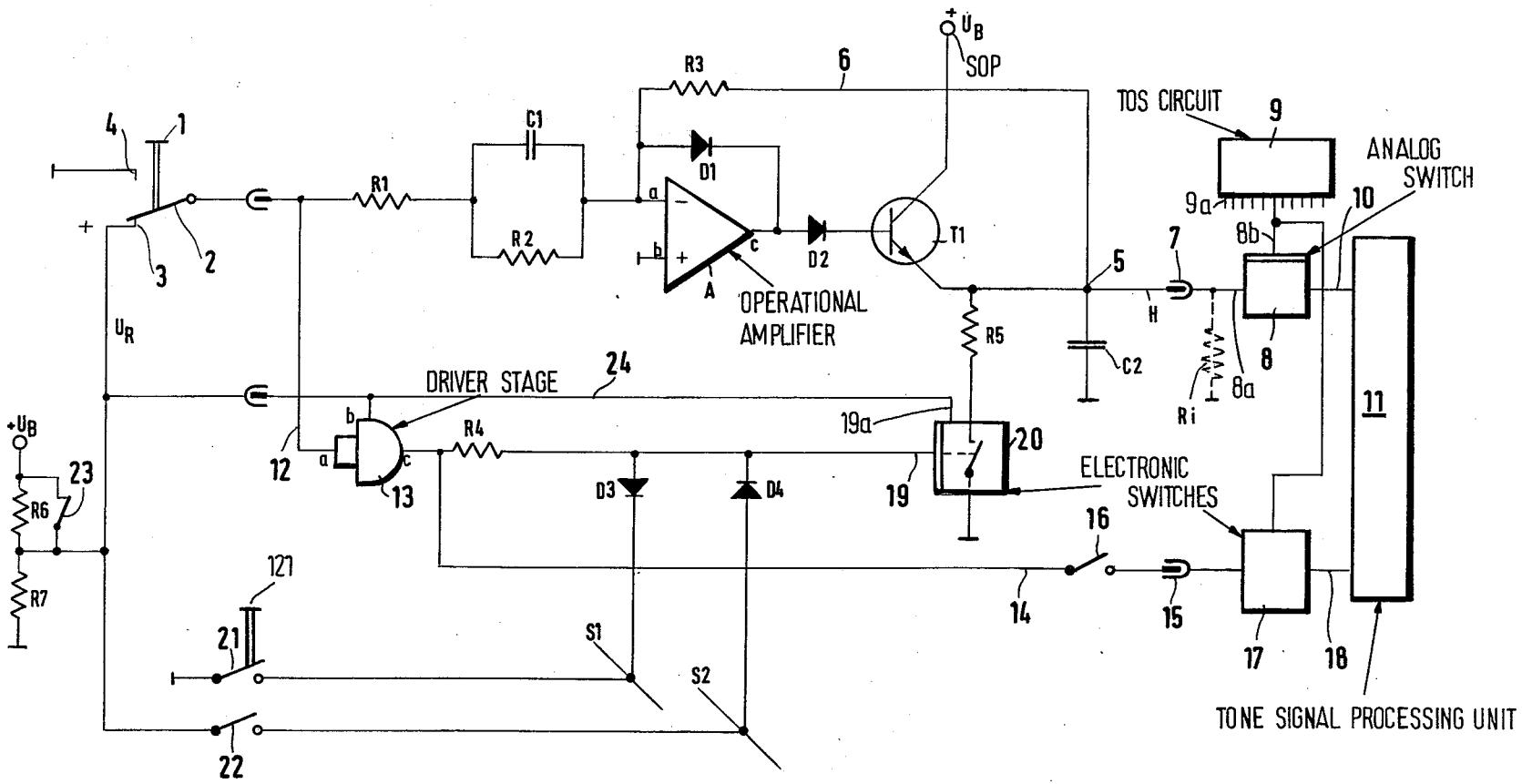
ANALOG SWITCH
TONE SIGNAL PROCESSING UNIT
TOS CIRCUIT
ELECTRONIC SWITCHES
OPERATIONAL AMPLIFIER
DRIVER STAGE
SOP
+U_B
U_R
R1
R2
R3
R4
R5
R6
R7
C1
C2
D1
D2
D3
D4
T1
S1
S2

SYSTEM FOR EXPANDING THE DYNAMIC VOLUME RANGE OF ELECTRONIC MUSICAL INSTRUMENTS

BACKGROUND OF THE INVENTION

The present invention relates to electronic musical instruments, and more particularly to improvements in means for expanding the dynamic volume range of such instruments. Still more particularly, the invention relates to improvements in electronic musical instruments of the type wherein envelope control voltage signals are generated in response to depression of keys and the intensity of such signals is a function of the length of intervals which elapse during movement of keys from non-depressed to depressed positions.

It is already known to construct an electronic piano (e.g., the 1974 version of the so-called Effekt-Piano manufactured by the West German firm WERSI) in such a way that the velocity of movement of a key from non-depressed to depressed position (i.e., the force which is applied to move the key between such positions) determines the length of the interval of discharge of a capacitor in the means for generating envelope control voltage signals. The capacitor is charged while the key is held in the non-depressed position. To this end, the capacitor is connected with a source of starting potential while the key assumes its normal (non-depressed) position, and the capacitor is connected with the ground when the key completes its movement to depressed position. Thus, the extent of discharge of the capacitor is a function of the length of interval of movement of the respective key to depressed position. If the interval is relatively short, the amplitude of the thus generated envelope control voltage is relatively low and the volume of the tone is also low. The means for amplifying tone signals is a transistor which conducts in response to the application of a certain minimum voltage (approximately 0.5 volt). Since the maximum remaining potential of the capacitor is not in excess of 10 volts, the application of a supply voltage in the range of 15 volts allows for a variation of the tone volume signal at a ratio of 20:1 which corresponds to a maximum achievable dynamic effect of approximately 26 decibels.

In a mechanical piano or a concert piano, the dynamic volume range is substantially greater; it is normally between 40 and 60 decibels which corresponds to volume differences of 100:1 to 1000:1.

OBJECTS AND SUMMARY OF THE INVENTION

An object of the invention is to provide a novel and improved electronic musical instrument whose dynamic volume range matches that of a mechanical piano.

Another object of the invention is to provide a novel and improved circuit which can be used in an electronic piano, electronic organ or an analogous electronic musical instrument to expand the dynamic volume range of such instrument.

A further object of the invention is to provide the electronic musical instrument with novel and improved means for processing tone signals and with novel and improved means for generating envelope control voltage signals.

An additional object of the invention is to provide an electronic musical instrument whose dynamic volume range reaches up to 80 decibels.

Another object of the invention is to provide the electronic musical instrument with novel and improved means for modifying tone signals so as to achieve special effects, such as sustenuto, banjo and/or others.

A further object of the invention is to provide the circuit with novel and improved means for enhancing the dynamic volume range of an electronic musical instrument and to construct and assemble such means with a view to allow for installation in existing electronic pianos or the like.

The invention is embodied in an electronic musical instrument which comprises key means movable between first and second positions at a plurality of different speeds, and means for generating an envelope control voltage signal including first capacitor means (e.g., a capacitor forming part of an RC-link), a key contact or analogous means for charging the first capacitor means in the first position of the key means (in which the key contact is connected with a source of starting voltage), means (e.g., the resistor of the aforementioned RC-link) for effecting discharge of the first capacitor means during movement of the key means to the second position so that the residual voltage of the capacitor means (namely, the voltage which remains at the time the key means reaches its second position) is a function of the speed of movement of the key means to the second position, amplifier means having an output and an input which is connected with the first capacitor means for the application of residual voltage thereto, a first feedback connection provided between the output and the input of the amplifier means and including means (e.g., a diode) for applying to the input a reference potential during movement of the key means from the first to the second position, second capacitor means connected with the output of the amplifier means (for example, by way of a second diode and a current amplifier, such as a transistor), and a second feedback connection provided between the second capacitor means and the input of the amplifier means and including an ohmic resistance. The envelope control voltage is supplied by the second capacitor means when the latter discharges in response to completion of movement of the key means to its second position.

The means for charging the first capacitor means preferably comprises a first contact which is permanently connected with a source of starting potential and is connected with the first capacitor means when the key means assumes its first position. The instrument further comprises a second contact which is preferably grounded and is connected with the first capacitor means in the second position of the key means. The key means may comprise or actuate the aforementioned key contact which respectively engages the first and second contacts in the first and second positions of the key means.

The resistor which effects discharge of the first capacitor means is connected in parallel with the first capacitor means. The diode in the first feedback connection ensures that the aforementioned reference potential is applied to the input of the amplifier means during discharge of the first capacitor means, i.e., while the key means moves from the first toward the second position. The diode between the output of the amplifier means and the second capacitor means prevents discharge of the second capacitor means by way of the amplifier means; the second capacitor means supplies envelope control voltage signals to an analog switch which is further connected to one output of a tone generator (e.g., to one of twelve outputs of a TOS circuit) to effect the transmission of a modulated tone signal to a further processing unit of the electronic musical instrument.

A current amplifier (e.g., a suitable transistor) can be connected between the aforementioned diode downstream of the output of the amplifier means and the second capacitor means. The means for effecting discharge of the second capacitor means includes one or more resistors connected or connectable in parallel with the second capacitor means. An electronic switch can be provided to vary the resistance of the just discussed resistor means, e.g., to vary the resistance of one of two resistors which are connected in parallel with the second capacitor means. The electronic switch can be actuated in dependency on the intensity of signal which is applied to the input of the amplifier means.

The novel features which are considered as characteristic of the invention are set forth in particular in the appended claims. The improved instrument itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a circuit diagram of a portion of an electronic musical instrument which embodies the present invention.

DESCRIPTION OF THE PREFERRED EMBODIMENTS

The electronic musical instrument which is shown in the drawing comprises a plurality of keys 1 (only one shown), namely, twelve keys for each octave, which form part of a single keyboard or of an upper manual and a lower manual. The illustrated key 1 is held in the normal (non-depressed) position in which a movable key contact 2 is held in a first position of engagement with a first stationary contact 3 (e.g., a bus bar) connected with a source of starting or "at rest" voltage $U_R$. When the key 1 is depressed or actuated, it causes the contact 2 to assume a second position of engagement with a second stationary contact 4 which is connected to the ground. The key contact 2 is connected with an RC-link including a primary capacitor C1 in parallel with a resistor R2; the connection comprises a charging resistor R1. The output of the RC-link C1, R2 is connected with the inverting input a of an operational amplifier A which has a ground second input b and an output c connected with the base of a current amplifying transistor T1 by way of a diode D2. The feedback connection between the output c and the input a of the amplifier A contains a diode D1. The collector of the transistor T1 is connected with a source SOP of supply voltage $U_B$ and the emitter of the transistor T1 is connected with a junction 5. A secondary capacitor C2 is connected between the junction 5 and the ground. The junction 5 is further connected with the input a of the amplifier A by a feedback conductor 6 containing a resistor R3. Therefore, a socket 7 (which is connected with the junction 5) receives an envelope control voltage signal H.

The signal H is applied to the input 8*a* of an analog switch 8 (e.g., a field effect transistor) whose second input 8*b* is connected with one of twelve outputs 9*a* of a top-octave synthesizer circuit 9 (also called TOS circuit) which forms part of the tone generator system of the musical instrument. The output 10 of the analog switch 8 transmits a modulated tone signal to the tone processing unit 11 of the musical instrument. The unit 11 comprises at least one amplifier and a sound reproducing device such as a loudspeaker. Reference may be had to commonly owned copending application Ser. No. 236,236 filed Feb. 20, 1981 by Reinhard Franz et al. for "Electronic musical instrument." The resistor R1 (indicated by broken lines) denotes the internal resistance of the circuitry which is connected to the socket 7.

The potential of the key contact 2 is applied to the input a of a driver stage 13 by a conductor 12. The ohmic resistance of the input a is extremely high, e.g., in excess of $10^{12}$ ohms. The output c of the driver stage 13 is connected with a socket 15 by way of a conductor 14 which contains a switch 16. When the switch 16 is closed, the driver stage 13 can actuate an electronic switch 17 whose output 18 then transmits a tone signal from an output 9*a* of the TOS circuit 9 to the corresponding input of the processing unit 11. The output c of the driver stage 13 is further connected with the input 19 of an electronic gate switch 20 by way of a buffer resistor R4. The switch 20 is connected in series with a discharging resistor R5 which latter is connected in parallel with the secondary capacitor C2. The input 19 of the electronic switch 20 is further connectable to the ground by a diode D3 which is in a series with a switch 21. Furthermore, the input 19 can be connected with the source of starting voltage $U_R$ by a conductor which contains a further switch 22 in series with a diode D4 whose connection is opposite to that of the diode D3. The switches 21 and 22 are common to all keys 1; therefore, the connections between the switches 21 and 22 on the one hand and the input 19 of the electronic switch 20 on the other hand comprise bus bars S1 and S2 to simplify the construction of the electronic musical instrument.

The starting potential $U_R$ normally matches the supply voltage $+U_B$. By resorting to a voltage divider including two resistors R6 and R7 shown in the lower left-hand portion of the drawing, the potential $U_R$ can be reduced to one-half of $+U_B$ in response to opening of a normally closed switch 23. A conductor 24 applies the starting potential $U_R$ to a second input b of the driver stage 13 as well as to the input 19*a* of the electronic switch 20 to serve as a supply voltage.

The operation is as follows:

When the key 1 is held in the illustrated non-depressed position, the primary capacitor C1 is charged to accumulate a voltage $U_{C1}=U_B(R2/R1+R2)$. The inverting input a of the operational amplifier A is maintained at zero potential (approximately +1 mv) by the diode D1. When the key 1 is depressed, the primary capacitor C1 discharges by way of the resistor R2 during the interval of movement of the key contact 2 from engagement with the first fixed contact 3 to engagement with the second fixed contact 4. Such discharge takes place in accordance with an e-function having a time constant C1 R2. When the key contact 2 is connected to the ground via second fixed contact 4, the secondary capacitor C2 is charged by way of the operational amplifier A to a value $U_{C2}=-U_{C1}\times(R3/R1)$. The charging is completed very rapidly because the current amplifier transistor T1 can supply relatively large currents. If the available operating range is utilized in its entirety, one can obtain for the envelope conrol voltage a dynamic volume range of approximately 80 decibels.

The secondary capacitor C2 is discharged by way of the internal resistance Ri, and such discharge is relatively slow to effect a gradual dying out of the tone signal passing through the analog switch 8. When the key 1 is released, the input 19 of the electronic switch 20 receives a start signal (unblocking signal) by way of the conductor 12, output c of the driver stage 13 and resistor R4 so that the switch 20 connects the discharging resistor R5 in parallel with the resistor Ri. The dying out of the tone then progresses rapidly, the same as in a mechanical piano.

On actuation of the switch 21, the control input 19 of the electronic switch 20 is connected with the ground via diode D3. Thus, the electronic switch 20 blocks whenever the switch 21 is closed and the secondary capacitor C2 discharges only via resistor Ri. This furnishes a prolonged sostenuto independently of release of the key 1 and corresponds to actuation or depression of the sostenuto pedal in a piano. Therefore, the switch 21 can be directly or indirectly connected with a pedal 121 of the electronic musical instrument which embodies the illustrated structure.

When the user of the musical instrument closes the switch 22, the input 19 of the electronic switch 20 is connected with the source of starting voltage $U_R$ by way of the diode D4. Therefore, the switch 20 is closed as long as the switch 22 remains in closed position. This entails rapid dying out of the tone signal immediately after start of generation of the envelope control voltage signal H because the secondary capacitor C2 discharges by way of the resistors R5 and Ri. The effects which are thereby obtained are similar to those which are typical of a banjo.

When the user decides to open the switch 23, the intensity of the starting voltage signal $U_R$ is reduced in half to thus reduce the volume of the tone accordingly. Therefore, opening of the switch 23 corresponds to actuation of a damping pedal in a normal piano. Consequently, the switch 23 can be directly or indirectly connected with and actuated by a pedal of the electronic musical instrument which embodies the illustrated structure.

The output c of the driver stage 13 transmits square pulses in dependency on actuation of the key 1. Such square pulses which are conveyed by the conductor 14 correspond to those which are generated by a conventional electronic organ and, therefore, such pulses can be used to effect the transport of tone signals independently of the volume of sound.

The feature that the secondary capacitor C2 is connected with the output c of the amplifier A (by way of the diode D2 and current amplifier T1) and with the input a of this amplifier by way of the resistor R3 ensures that the secondary capacitor C2 is charged subsequent to charging of the primary capacitor C1, namely, the charging of secondary capacitor C2 begins as soon as the key contact 2 reaches the second fixed contact 4. However, the provision of feedback connections between the output c and the input a of the amplifier A ensures that the potential which is applied to the secondary capacitor C2 immediately assumes a value which corresponds to residual voltage of the primary capacitor C1. All that necessitates consideration is the relatively low offset voltage of the amplifier A which is in the range of 1.5 mv. Moreover, the feedback connections of the amplifier A allow for a multiplication of potential so that the maximum residual voltage of the primary capacitor C1 which is charged by way of the key contact 2 equals or can equal the maximum supply voltage which is normally in the range of 15 volts. This leads to a voltage ratio at the capacitor C2 of 10000:1 and corresponds to a dynamic range of the circuit in the region of approximately 80 decibels.

The provision of a diode (D1) in the respective feedback connection between the output c and the input a of the amplifier A ensures that the potential at the input a is invariably held at a predetermined value until the key contact 2 reaches and engages the second fixed contact 4. The diode D1 further provides a path for the flow of charging current for the primary capacitor C1. As a rule, the diode D1 will be utilized to normally maintain the input a of the amplifier A at zero potential.

The diode D2 between the output c of the amplifier A and the current amplifier T1 prevents the secondary capacitor C2 from discharging by way of the amplifier A. This invariably prevents untimely discharge of the secondary capacitor C2.

As stated above, the provision of the current amplifier T1 between the output c of the amplifier A and the junction 5 (capacitor C2) ensures that the secondary capacitor C2 can be rapidly charged to a potential which corresponds to residual potential of the primary capacitor C2. There is no need for a powerful current amplifier. The aforementioned advantages are achieved in spite of the provision of the current amplifier T1 because the feedback branch which includes the resistor R3 (i.e., the conductor 6) also contains the secondary capacitor C2.

The placing of the secondary capacitor C2 in parallel with the discharging resistor means R1 and R5 allows for gradual dying out of the envelope control voltage which is supplied to the input 8*a* of the analog switch 8 when the secondary capacitor C2 discharges. Gradual dying out of envelope control voltage signals produces the aforediscussed sostenuto effect which is desirable in instruments that imitate mechanical pianos. In its simplest form, the resistor means for discharge of the secondary capacitor C2 may include only the resistor Ri, i.e., the internal resistance of the parts connected downstream of the junction 5.

The switch 20 renders it possible to vary the resistance of resistor means for discharge of the secondary capacitor C2. As explained above, this allows for a relatively long or a relatively short sustain effect. An electronic switch is preferred at this time. Since the switch 20 is rendered conductive in dependency on the potential at the key contact 2, it is possible to achieve a long sustain when the key 1 is depressed and a short sustain when the key is released. This switch is connected in series with the resistor R5 which constitutes one branch of the resistor system for discharge of the secondary capacitor C2. The switch 20 conducts when the key contact 2 engages the first stationary contact 3, i.e., when the corresponding input 19*a* of the switch 20 receives the potential $U_R$ via conductor 24. When the key 1 is released to return to the illustrated non-depressed position, the resistor R5 is connected with the source of starting voltage $U_R$ via switch 20 so that one obtains the desired short sustain effect.

The driver stage 13 (with a first input a whose ohmic resistance is preferably in excess of $10^{12}$ volts) connects the key contact 2 with the input 19 of the switch 20 to prevent feedback. This driver stage is switched on in response to the application of starting potential $U_R$.

The provision of the switch 23 in the voltage divider including the resistors R6 and R7 is desirable and advantageous because opening of the switch 23 entails a reduction of the starting potential $U_R$. This produces the same effect as a damper pedal in a mechanical piano. Thus, the charge of the primary capacitor C1 is lower when the switch 23 is open and, consequently, the residual voltage of the capacitor C1 (after the key 1 has completed its movement from the illustrated first to the other or second position in which the key contact 2 engages the second stationary contact 4) is lower and the volume of the tone which is produced in response to discharge of such residual voltage is reduced accordingly. By connecting the input a of the driver stage 13 and the input 19*a* of the electronic switch 20 with the source of starting potential $U_R$ by way of the key contact 2, one ensures that the components 13 and 20 can distinguish between the two positions of the key contact 2 even if the starting voltage $U_R$ is reduced in response to opening of the switch 23 for the voltage divider R6, R7.

It will be noted that the conductor 14 is connected with the output c of the driver stage 13 ahead of the blocking resistor R4. This conductor transmits signals to the electronic switch 17 when the switch 16 is closed. Thus, such connection between the output c of the driver stage 13 and the electric switch 17 renders it possible to activate a combination of elements which, heretofore, were actuatable solely by a simple on-off signal, for example, in the case of electronic keying of an electronic organ. The conductor 14 can supply voltages to actuate format filters as well as trigger voltages to initiate special effects without any feedback.

In the illustrated presently preferred embodiment of the invention, the voltage of the secondary capacitor C2 is applied to the control input 8*a* of the analog switch 8 (preferably a field effect transistor) to effect the transmission of a tone signal from the corresponding output 9*a* of the TOS circuit 9. Consequently, the circuitry which follows the electronic switch 8 needs not embody a transistor switch to furnish a threshold voltage. This is due to the fact that, by resorting to the field effect transistor T1, the linear activating range can be expanded to between 60 and 80 decibels. Reference may be had to the commonly owned copending application Ser. No. 236,236 filed Feb. 20, 1981 by Reinhard Franz et al. for "Electronic Musical Instrument."

The following integrated circuits may be used in the electronic musical instrument which embodies the present invention: The operational amplifier A may constitute a component known as TL 074 which is manufactured and sold by Texas Instruments; the TOS circuit 9 may constitute a component known as MO 82 which is manufactured by SHS-ATES (Italy and UK); the analog switch 8 may constitute a component known as 4016 manufactured by National Semiconductor; the driver stage 13 may constitute a component known as 4050 manufactured by National Semiconductor; and the electronic switch 20 may constitute a component known as 6020 manufactured by National Semiconductor.

In the embodiment which has been tested by resorting to the above-enumerated commercially available components, the resistor ratio R3:R1 was 3:2. The supply voltage was 15 volts. This enabled the improved musical instrument to operate within a dyanmic volume range of 6–80 decibels.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In an electronic musical instrument, the combination of key means movable between first and second positions at a plurality of different speeds; and means for generating an envelope control signal, comprising first capacitor means, means for charging said capacitor means in the first position of said key means, means for effecting discharge of said capacitor means during movement of said key means to said second position so that the residual voltage of said capacitor means is a function of the speed of movement of said key means to said second position, amplifier means having an output and an input connected with said capacitor means for the application of said residual voltage to said input, a first feedback connection provided between said output and said input and including means for applying to said input a reference potential during movement of said key means from said first to said second position, second capacitor means connected with said output, and a second feedback connection provided between said second capacitor means and said input and including an ohmic resistance.

2. The combination of claim 1, wherein said means for charging said first capacitor means comprises a source of starting potential, a first contact connected with said source and further connected with said first capacitor means in the first position of said key means, and further comprising a grounded second contact which is connected to said first capacitor means by way of said key means when the latter reaches said second position.

3. The combination of claim 1, wherein said means for effecting discharge of said first capacitor means comprises resistor means connected in parallel with said first capacitor means.

4. The combination of claim 1, wherein said means for applying reference potential to the input of said amplifier means includes a diode.

5. The combination of claim 1, further comprising a diode connected between said output and said second capacitor means for preventing discharge of said second capacitor means by way of said amplifier means.

6. The combination of claim 1, further comprising current amplifier means having input means connected with the output of said amplifier means and output means connected with said second capacitor means.

7. The combination of claim 1, further comprising means for effecting discharge of said second capacitor means, including resistor means connected in parallel with said second capacitor means.

8. The combination of claim 7, further comprising means for varying the resistance of said resistor means.

9. The combination of claim 8, wherein said resistance varying means comprises switch means.

10. The combination of claim 9, wherein said switch means comprises an electronic switch and means for actuating said switch in dependency on the intensity of signal which is applied to the input of said amplifier means.

11. The combination of claim 10, wherein said switch is arranged to conduct in one position of said key means.

12. The combination of claim 9, wherein said resistor means comprises a plurality of resistors including a first resistor in series with said switch means and further comprising means for rendering said switch means conductive in the first position of said key means.

13. The combination of claim 9, wherein said means for rendering said switch means conductive has an input with a high ohmic resistance and further comprising a source of starting potential connected with the input of said means for rendering said switch means conductive in the first position of said key means.

14. The combination of claim 9, wherein said switch means includes an electronic switch having input means and further comprising means for connecting the input means of said switch means with the ground.

15. The combination of claim 14, wherein said means for connecting the input means of said switch means to the ground comprises a normally open switch and a diode in series with said normally open switch.

16. The combination of claim 9, wherein said switch means comprises an electronic switch having input means and further comprising a source of starting potential and means for connecting said source to the input means of said electronic switch.

17. The combination of claim 16, wherein said connecting means comprises a switch and a diode in series with said last named switch.

18. The combination of claim 1, further comprising means for varying the voltage which is applied to said first capacitor means in the first position of said key means.

19. The combination of claim 18, wherein said varying means comprises switch means actuatable to reduce the intensity of said voltage.

20. The combination of claim 1, further comprising means for effecting discharge of said second capacitor means including electronic switch means having first and second input means and output means, and resistor means connected with the output means of said switch means, a source of starting potential, and a driver stage having an input connected with said source and an output connected with the first input means of said electronic switch means, said second input means of said electronic switch means being connected with said source.

21. The combination of claim 1, wherein said generating means further comprises means for effecting discharge of said second capacitor means including a resistor connected in parallel with said second capacitor means, an electronic switch in series with said resistor and means for actuating said electronic switch including a driver stage having an input connected with said key means and an output connected with said electronic switch, and further comprising tone generator means, tone processing means and means for transmitting tone signals from said tone generator means to said tone processing means in response to signals from said driver stage.

22. The combination of claim 21, wherein said transmitting means comprises a second electronic switch and further comprising conductor means connecting the output of said driver stage with said second electronic switch.

23. The combination of claim 22, further comprising blocking resistor means interposed between the output of said driver stage and said first named electronic switch, said conductor means being connected with the output of said driver stage ahead of said blocking resistor means.

24. The combination of claim 1, wherein said generating means further comprises means for effecting discharge of said second capacitor means and further comprising tone signal generating means, tone signal processing means and means for connecting said tone signal generating means with said processing means in response to discharge of said second capacitor means.

25. The combination of claim 24, wherein said means for connecting said tone signal generating means with said processing means comprises an analog switch which is actuated in response to the application of an envelope control signal by said second capacitor means.

26. The combination of claim 25, wherein said analog switch comprises a field effect transistor.

* * * * *